United States Patent [19]

Berg

[11] 4,059,156

[45] Nov. 22, 1977

[54] GEOTHERMAL BRINE PRODUCTION

[76] Inventor: Clyde H. Berg, 3655 E. Ocean Blvd., 2-H, Long Beach, Calif. 90803

[21] Appl. No.: 681,565

[22] Filed: Apr. 29, 1976

[51] Int. Cl.[2] ..... E21C 43/28

[52] U.S. Cl. ..... 166/314; 165/45; 166/244 C; 299/6

[58] Field of Search ..... 166/244 C, 314, 265; 299/4, 5, 6; 165/45

[56] References Cited

U.S. PATENT DOCUMENTS

| | | | |
|---|---|---|---|
| 1,649,385 | 11/1927 | Blumenberg | 299/5 |
| 3,372,753 | 3/1968 | Tuttle | 166/314 |
| 3,653,717 | 9/1969 | Rich et al. | 299/5 |
| 3,782,468 | 1/1974 | Kuwada | 166/265 X |

*Primary Examiner*—Ernest R. Purser
*Attorney, Agent, or Firm*—Fulwider, Patton, Rieber, Lee & Utecht

[57] ABSTRACT

There is disclosed a method for the production of geothermal brines that avoids depressuring the brine below its flash point in the well bore and thereby avoids the scaling and plugging unavoidably experienced whenever high salt content brines are depressured, releasing carbon dioxide and upsetting their solubility equilibrium and precipitating calcium carbonate. The invention avoids the flashing of the geothermal brine by injecting a lift fluid immiscible with and of substantially lesser density than the brine into the production tubing to form a column of a mixture of brine and lift fluid which has a sufficiently lesser density than the column of brine that the hydrostatic head of the column of brine raises the mixture to the surface from where it is withdrawn without flashing, separating the lift fluid and processing the brine for heat recovery. Where the brine is extremely hot, the pressure is maintained at higher levels to avoid flashing by an additional column of brine below the production level. This is provided by establishing a column of the geothermal brine a substantial depth below its production interval, installing a production tubing for a substantial depth in the column of brine and injecting a lift fluid which yields a higher pressure at the top of the well.

11 Claims, 2 Drawing Figures

GEOTHERMAL BRINE PRODUCTION

BACKGROUND OF THE INVENTION

1. Field of the Invention

This invention relates to geothermal energy recovery and, in particular, to a method of producing geothermal brines having high contents of dissolved salts.

2. Brief Statement of the Prior Art

Geothermal energy in the form of natural steam and hot brine is a natural resource of substantial magnitude. At present, only a few attempts have been made to recover this energy and these attempts have been directed almost entirely to the production of steam from subterranean natural steam reservoirs. Unfortunately, most geothermal energy exists as hot, subterranean brines which are difficult to process for heat recovery because of their high corrosive and scaling characteristics. Attempts have been made to position heat exchangers in well bores penetrating a geothermal brine interval. These attempts have not been successful because of the corrosive attack and scaling of the heat exchanger surfaces by the subterranean brines. Attempts have been made to produce geothermal brine, depressuring the brine as required for lifting to the surface. Unfortunately, the brine releases carbon dioxide and other congeneric gases as it is depressured, upsetting the solubility equilibrium of its dissolved salts and depositing copious quantities of calcium carbonate, often plugging the well within the first or second week of attempted production.

BRIEF STATEMENT OF THE INVENTION

This invention provides a method for the production of geothermal brines that have a high content of dissolved salts such that any substantial depressuring of the brine results in precipitation of calcium carbonate and other scale therefrom. The method of this invention provides for the production of the geothermal brine without depressuring of the brine in the well bore. This is accomplished by establishing a subterranean column of the geothermal brine a substantial depth below its production interval, installing of a production tubing in the column of brine and injecting a lift fluid, immiscible with and of a substantially lesser density than the brine, into intimate mixture with the brine near the lower end of the production tubing. The mixture of brine and lift fluid in the production tubing is of substantially lesser density than the surrounding column of brine and the hydrostatic head of the column of brine will displace the mixture of brine and lift fluid up the production tubing to the surface from where it can be withdrawn and processed.

BRIEF DESCRIPTION OF THE DRAWINGS

The preferred mode of practicing the invention will be described with reference to the figures of which.

DESCRIPTION OF PREFERRED EMBODIMENTS

Figure 1:
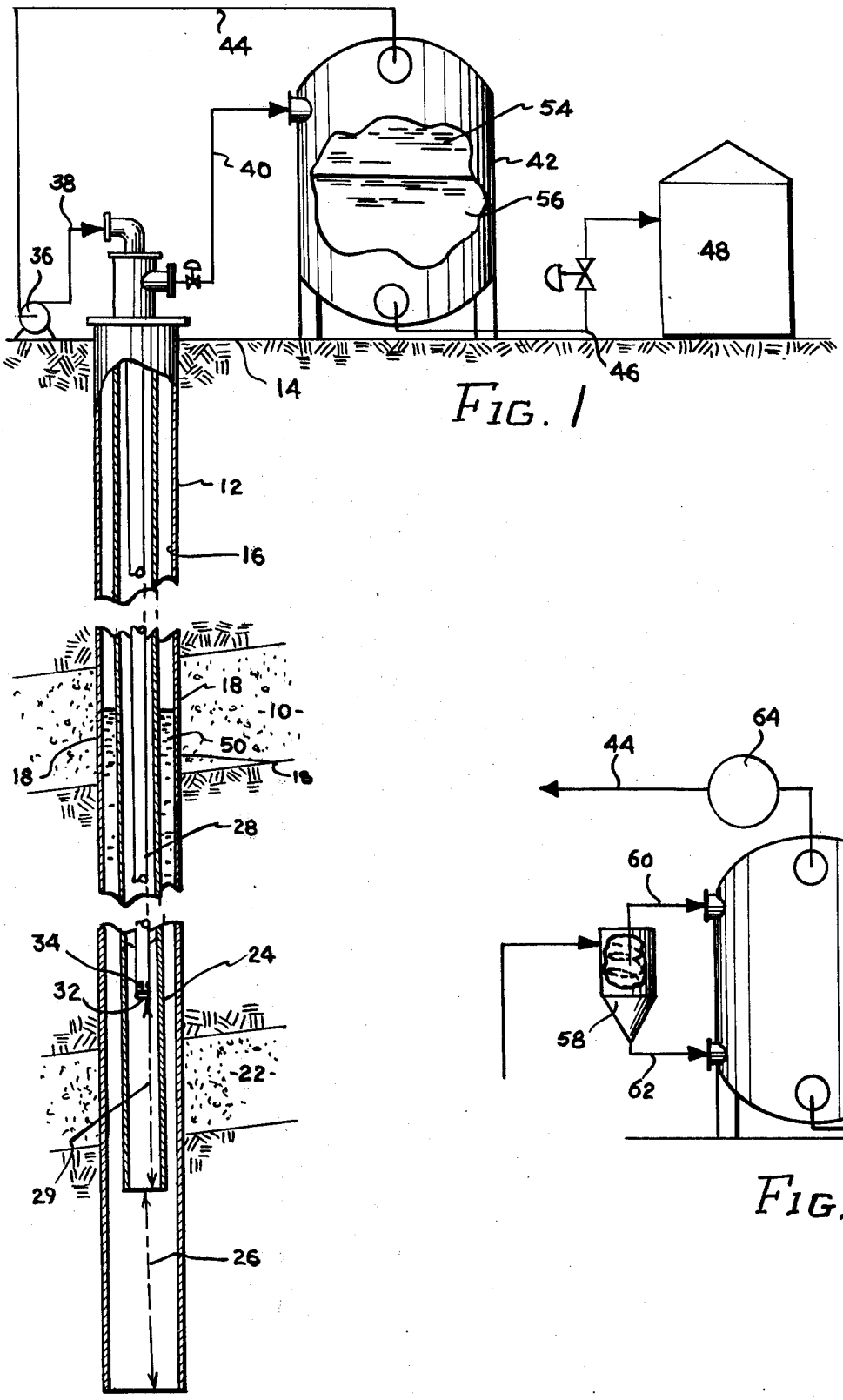
FIG. 1 illustrates the production well and related onsite facilities.

Referring now to FIG. 1, there is illustrated an application of the invention for the production of geothermal brine. The geothermal brine for production is present in a subterranean interval 10 which is penetrated by a well bore 12 drilled from the surface 14 to a depth penetrating the brine interval 10 and extending for a substantial distance therebeneath. The well bore is lined with a casing 16 in a conventional manner which is perforated at 18 in the production interval 10, thereby sealing the well bore 12 from other intervals of brine, oil, and the like, such as interval 22.

A string of tubing 24 is installed in the well bore to extend a substantial depth beneath the production interval 10. This production tubing can be open-ended at its lower end and terminates a short distance 26 above the bottom of well bore 12. A second string of tubing 28 is introduced into the well bore; in the illustrated embodiment, the second string of tubing 28 is concentric within tubing 24. This tubing 28 also extends a substantial distance beneath the production interval 10 and terminates within the outer tubing 24 a distance 29 above the lower end thereof. The second string of tubing 28 can be open-ended or, preferably, can bear a closure member 32 with a plurality of apertures 34, thereby establishing communication between the first and second strings of tubing.

The onsite facilities located at the surface of the well bore includes injection facilities such as pump 36 having its high pressure discharge connected by line 38 to the second string of tubing 28 and a line 40 communicating from the first string of tubing 24 to a vessel 42. The upper end of vessel 42 is connected through line 44 to the suction side of pump 36 while the lower end of vessel 42 is connected through line 46 to an energy recovery station 48.

The geothermal brine from production interval 10 drains into the well bore 20 through perforations 18 in the well bore casing, establishing a column 50 of brine therein. A lift fluid is injected by pump 36 into the well bore through the second string of tubing 28 from where it is discharged through apertures 34 into intimate contact with the brine within the second string of tubing 24 which surrounds the discharge end of tubing 28.

The lift fluid which is employed is a fluid that is immiscible with and of substantially lesser density than the geothermal brine. Suitable lift fluids which can be employed are hydrocarbons, e.g., mineral oil distillates such as gas, oil, kerosene, naptha, pentane, butane, propane, ethane, methane, nitrogen, air, helium, argon, etc.

The lift fluid is maintained under sufficient pressure to maintain it as a liquid or gas and at a pressure at least equal to the subterranean reservoir pressure of the brine in interval 10. The lift fluid is injected into contact with the geothermal brine in a sufficient degree of dispersion to create finely subdivided droplets or bubbles which are intermixed with the brine phase and which thereby form a mixture of brine and lift fluid that is of substantially lesser density than the geothermal brine. Typically, geothermal brines have densities from 1.05 to about 1.30 and contain from 0.5 to about 35 weight percent of dissolved salts, with calcium bicarbonate being present in the amount from 0.2 to about 5 weight percent. Such geothermal brines are prevalent in subterranean reservoirs at depths from about 1,000 to about 10,000 feet or more, typically at depths of about 2,000 to about 7,000 feet. These brines are often found at pressures from 100 to about 3,000 p.s.i. and at temperatures from about 200° to about 700° F.

The mixture of brine and lifting fluid is of substantially lesser density than the brine of the surrounding column 50 of brine. This is achieved by injecting the lift fluid at a rate sufficient to provide from 15 to about 80 volume percent, preferably from 25 to about 75 volume percent, of lift fluid in the brine. Typically, this provides a mixture having a density which is from about 40 to about 90 percent of that of the geothermal brine.

The hydrostatic head of the surrounding column 50 of the brine exerts sufficient pressure on the mixture of brine and lift fluid to elevate the mixture to the surface without allowing the mixture to flash. The hydrostatic head is achieved by the height of column 50, density and rate of injection of the lift fluid and/or rate of production of the mixture of lift fluid and geothermal brine through line 40.

Any settling or separation tendencies of the immisicible lift fluid and geothermal brine that may be experienced in their transit through the string of tubing 24 can be offset by injecting the lift fluid into contact with the brine as minute droplets and/or by maintaining the annular flow area through production tubing 24 sufficiently small to maintain a lift velocity which exceeds the settling velocity of the droplets.

The mixture of the lift fluid and geothermal brine is withdrawn from the string of tubing 24 through line 40 and passed to a separation vessel 42 where the mixture is maintained under sufficiently quiescent conditions to permit separation of the immiscible phases. The upper phase 54 of the lift fluid is withdrawn through line 44 and passed to pump 36 for injection into the well bore. The lower phase 56 in separation drum 42 comprises the geothermal brine which, preferably, is still under the superatmospheric pressure of the subterranean interval 10. This brine can be withdrawn through line 46 to further treatment and energy recovery steps generally indicated at 48.

Figure 2:
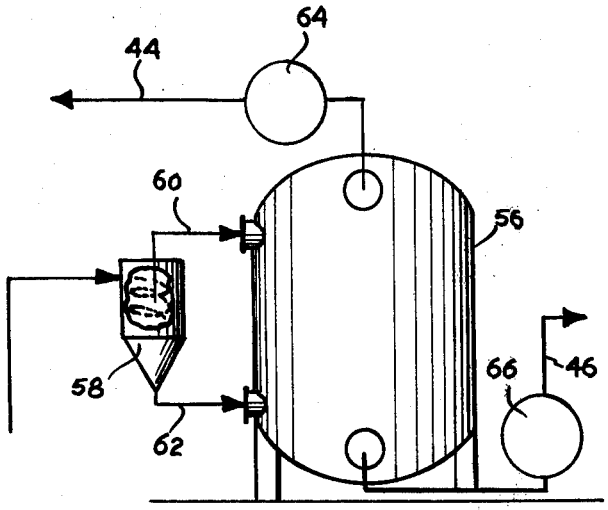
FIG. 2 illustrates an alternative processing of the lift fluid and geothermal brine.

The separation of the phases 54 and 56 in settling vessel 42 can be accelerated by various means. A suitable technique is shown in FIG. 2 where the mixture of lift fluid and geothermal brine is introduced into a centrifugal separator 58 and the like and passed in helical flow therein with the lower density phase being withdrawn through line 60 and the higher density phase withdrawn through line 62. These lines communicate with upper and lower portions of separation vessel 56. The separation vessel 56 can also be provided with heat recovery facilities, e.g., heat exchanger such as conventional tube and shell heat exchangers 64 and 66 that can be located, respectively, in lines 44 and 46. Alternatively, indirect heat exchange coils can be placed directly in vessel 56. A heat exchange working fluid can be passed through the heat exchangers 64 and 66 in indirect heat exchange relationship to the process fluids and the resultant, heated working fluid can then be passed to suitable energy recovery steps such as turbines and the like for generation of power.

Once the geothermal brine has been removed from the well bore, the brine can be passed into equipment having adequate provision for cleaning of any scale deposits and the pressure of the geothermal brine can be reduced. The mixture withdrawn through line 46 is depressured through a valve and passed to a separation vessel. When the lift fluid employed is relatively volatile, e.g., when methane, ethane, propane and the like are employed, the lift fluid is separated in the separation vessel as in all other cases. The volatile lift fluid can be recovered by suitable processing facilities, repressured and returned for injection into the well.

The liquid brine is flashed into steam which can be withdrawn and passed to suitable energy recovery steps, e.g., expansion in a work-generating turbine. The brine residue, which contains dissolved and suspended quantities of salts and solids, can be passed to indirect heat exchange with a working fluid and the like for further energy recovery and thereafter injected into the geothermal interval 10 or otherwise disposed of.

The invention has been described by reference to the illustrated and presently preferred embodiment thereof. It is not intended that this illustration and description of the preferred embodiment be unduly limiting of the invention. Instead, it is intended that the invention be defined by the means and steps, and their obvious equivalents, set forth in the following claims.

What is claimed is:

1. A method for the recovery of energy from a high temperature geothermal brine present in a subterranean interval at superatmospheric pressure and subject to deposition of calcium carbonate upon a substantial reduction of its pressure which comprises:

forming a column of said brine extending a depth to said interval;

positioning a first tubing string in said column of said brine and a second tubing string therein terminating above the lower end of said first tubing string and in fluid communication therewith;

injecting into said second tubing string a lift fluid immiscible with and of substantially lesser density than said brine to discharge from said second into said first tubing string and form an intimate admixture with said brine having a density sufficiently less than the density of said brine whereby said column of brine surrounding said first tubing string exerts a sufficient hydrostatic head on said mixture to lift said mixture to the surface through said first tubing string; and withdrawing said mixture of brine and lift fluid from said first tubing string while maintaining the mixture under superatmospheric pressure sufficient to prevent the release of gases therefrom and thereby preventing the precipitation of calcium carbonate scale within said tubing string.

2. The method of claim 1 wherein said step of forming said column of brine comprises penetrating said interval with a well bore and establishing a column of brine within said well bore.

3. The method of claim 2 also including the step of lining said well bore with a casing and perforating the casing at the level of said geothermal interval.

4. The method of claim 1 including the step of separating said lift fluid from the mixture of brine and lift fluid withdrawn from said first tubing string while maintaining said mixture under said superatmospheric pressure.

5. The method of claim 4 wherein said step of separating comprises passing said mixture of brine and lift fluid into a settling vessel to permit the immiscible liquids to separate as distinct phases and withdrawing said lift fluid as the upper phase of said separating vessel.

6. The method of claim 4 wherein said mixture is passed through a centrifugal separator to accelerate said separation of brine and lift fluid.

7. The method of claim 4 wherein said step of separating comprises passing said mixture of brine and lift fluid into a settling vessel maintained at said superatmospheric pressure to permit the immiscible liquids to separate as distinct phases therein and withdrawing said lift fluid as the upper phase of said separating vessel.

8. The method of claim 5 including the step of recovering sensible heat from said geothermal brine.

9. The method of claim 7 including the step of recovering sensible heat from said separated lift fluid before reinjecting said lift fluid.

10. The method of claim 1 wherein said lift fluid is a mineral oil distllate.

11. The method of claim 1 wherein said lift fluid is selected from the class of noncondensible gases, such as nitrogen, air, helium, argon and the like.

* * * * *

UNITED STATES PATENT OFFICE

CERTIFICATE OF CORRECTION

Patent No. 4,059,156 Dated November 22, 1977

Inventor(s) Berg, Clyde H.

It is certified that error appears in the above-identified patent and that said Letters Patent are hereby corrected as shown below:

Delete Claim 5 and substitute therefor:

--5. The method of Claim 4 including the step of repressuring said separated lift fluid and reinjecting said lift fluid into said tubing string.--

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*